United States Patent [19]

Cullinan

[11] 4,345,640

[45] Aug. 24, 1982

[54] REGENERATIVE HEAT EXCHANGER BASKET

[76] Inventor: Edward J. Cullinan, 411 Opatrny Dr., Fox River Grove, Ill. 60021

[21] Appl. No.: 262,470

[22] Filed: May 11, 1981

[51] Int. Cl.[3] ..... F28D 19/04

[52] U.S. Cl. ..... 165/10

[58] Field of Search ..... 165/10

[56] References Cited

U.S. PATENT DOCUMENTS

| | | | |
|---|---|---|---|
| 2,432,198 | 12/1947 | Karlsson et al. | 165/10 |
| 3,301,316 | 1/1967 | Mason | 165/10 X |
| 3,308,876 | 3/1967 | Gram, Jr. et al. | 165/10 |
| 3,314,472 | 4/1967 | Krumm et al. | 165/10 |
| 3,379,240 | 4/1968 | Woolard et al. | 165/10 |
| 3,465,815 | 9/1969 | Wheeler | 165/10 |
| 3,605,874 | 9/1971 | Brunell | 165/10 X |
| 3,996,997 | 12/1976 | Regan et al. | 165/10 X |

FOREIGN PATENT DOCUMENTS

| | | | |
|---|---|---|---|
| 865625 | 2/1953 | Fed. Rep. of Germany | 165/10 |

*Primary Examiner*—Albert W. Davis

*Attorney, Agent, or Firm*—Howard H. Darbo

[57] ABSTRACT

The bars that abut the ends of the plates employed as heat storing elements in a basket for a regenerative heat exchanger are received in recesses in the ends of the plates. These recesses are sufficiently large so that the exterior edges of the plates are approximately planar with the outer edges of the bars. Whereby, for a basket of a given size additional plate surface is obtained in the basket and the bars will better serve to retain deteriorated plates in the basket.

1 Claim, 3 Drawing Figures

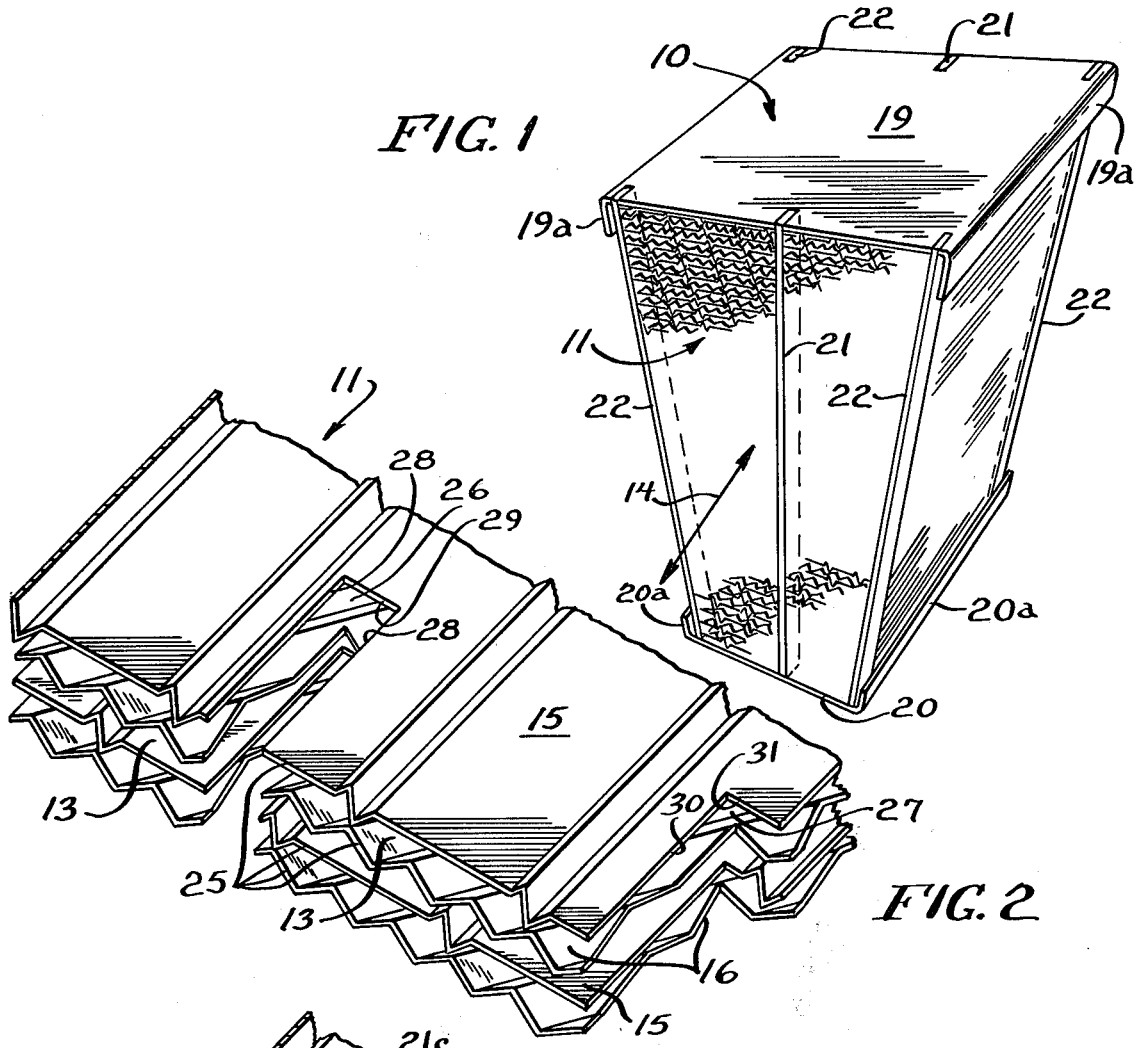
FIG. 1
FIG. 2
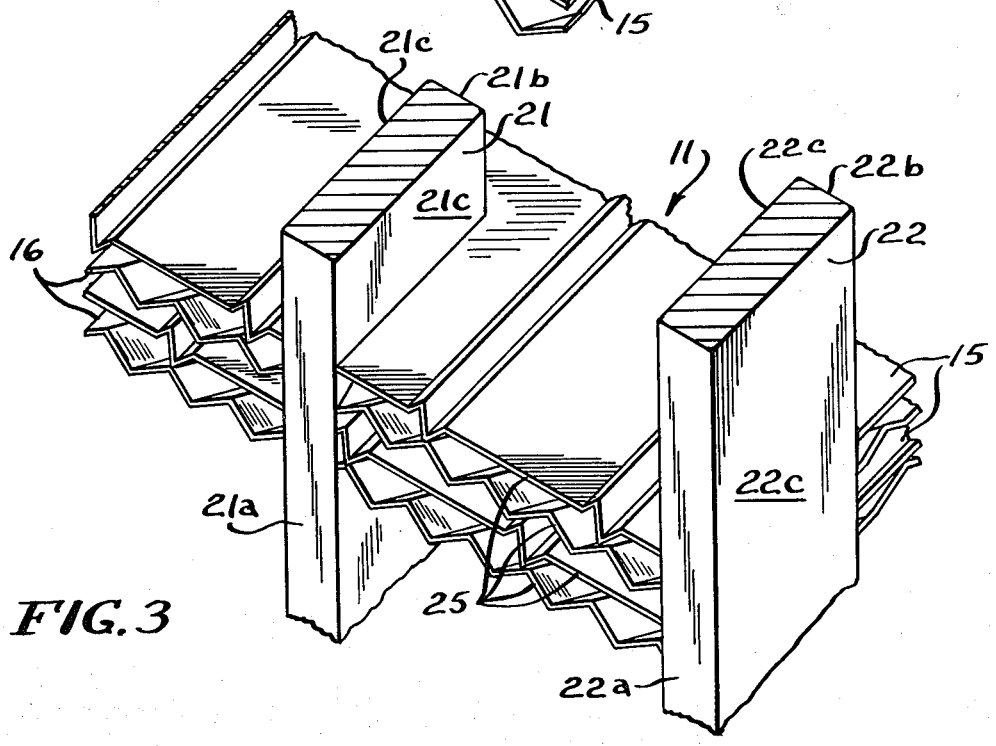
FIG. 3

REGENERATIVE HEAT EXCHANGER BASKET

BACKGROUND AND SUMMARY OF THE INVENTION

The present invention relates to an improvement in the baskets of a regenerative heat exchanger.

Regenerative heat exchangers are employed to transfer heat from one stream of fluid to another. They employ a plurality of plates which serve as heat storing elements which are alternately exposed to the two fluid streams which are at different temperatures and thereby transfer heat from one stream to another. For example, when exposed to the higher temperature fluid stream the plates pick up heat which, when the plates are exposed to the lower temperature fluid stream, is passed on to the latter stream. In one common form of such regenerative heat exchanger there are a plurality of "baskets" mounted in a continuously moving rotor. Each basket contains a plurality of plates which define air passages therebetween. At one point along the rotational path of the rotor there is stationary duct work which directs the flow of one fluid stream through the passages of the basket while at another location along the rotor path another duct work directs another fluid stream through the basket. In some versions of the regenerative heat exchangers, the member holding the baskets is stationary with the elements forming the two ducts being rotational with respect thereto.

One field in which such regenerative heat exchangers is extensively used is that of steam boilers. There the heat exchangers are employed to transfer heat from the hot gases which result from the combustion to the comparatively cool (ambient) intake air which is to be employed for combustion. Because the hot gaseous stream resulting from combustion tends to be rather corrosive the plates which are exposed thereto will deteriorate in time. This is particularly true in the case of boilers employing a fuel which when burned produces large quantities of corrosive gases. A fuel falling into this category is a high sulphur coal. As a consequence, the heat exchanger plates are assembled in groups, with each group being held in a "basket" which is removably mounted in the heat exchangers. Thus when the plates of a given basket are seriously deteriorated the basket can be replaced to provide a fresh set of plates.

As the plates so deteriorate they become thinner, thus occupying less space and being more fragile to an increasing degree as the deterioration progresses. In the commonly employed heat exchanger having the baskets mounted in a rotor, this results in a shifting of the plates in the basket. Also a movement of the plates in the basket will be occasioned by the force of the fluid stream passing therethrough, which induces a fluttering of the plates. Any such movement of the plates can serve to cause breakage of the plates after they have become fragile as a result of deterioration. Obviously, problems can result when the plates commence to move in the basket and when the plates begin to fracture.

The optimum would be to remove a basket containing deteriorated plates before the plates had deteriorated to an extent such that such problems would commence to occur. But this is not always practical. The operation of changing baskets generally requires that the heat exchanger be removed from service. Since usually there is not a standby heat exchanger, this means that the steam boiler must be shut down. The shutting down of a steam boiler of a large electrical generating plant can reduce the electrical output of the plant, thus cutting the electrical energy available to the users of electrical power serviced by the plant. Therefore the boiler can be shut down only at such times as supplemental electrical power from other sources is available. Upon occasions where supplemental electric power has not been reasonably available, it has been necessary to keep a boiler operating even though it was known that the plates of the heat exchanger had seriously deteriorated. Another factor that affects the timing of the changing of the baskets is that in many instances they are large and heavy, requiring the use of large, powered mechanical equipment to perform the task. Such equipment may have to be brought in from other locations and the scheduling thereof cannot be done over night.

One solution for the problem of shifting plates that has been proposed is to spring load the stack of plates in the basket thereby seeking to hold them in place even though the plates become thinner as a result of deterioration. An example of this is seen in U.S. Pat. No. 3,314,472. The commercial embodiments of such a construction may serve to hold the plates in place even though there has been some plate deterioration, but it appears that insufficient spring loading is present to accomplish that result with seriously deteriorated plates. Furthermore, it seems likely that were sufficient spring loading provided to take up the excess space with seriously deteriorated plates, that spring loading would itself have a deleterious effect on such seriously deteriorated plates due to their fragile condition.

In other constructions, the basket framework incorporates bars across the ends of the basket, which bars abut the end edges of the plates and serve to prevent the plates from shifting endwise in the basket. An example of such a construction will be seen in FIG. 3 of U.S. Pat. No. 3,379,240. Depending upon the number and placement of such bars, they can form a cage to trap even rather seriously deteriorated plates in the basket.

With respect to the present invention, there is another factor present in regenerative heat exchangers that is significant. That is, the matter of capacity of the heat exchanger. The capacity of the heat exchanger, that is the amount of heat that it will transfer between two fluid streams differing in temperature by a specific amount, is affected by the mass of the heat storing elements, the surface area of that mass and the material that constitutes the mass. Since generally it is not practical to change the material, the principal design considerations are mass and surface area. For a given heat exchanger, which will accept baskets having given maximum dimensions, the greater is the mass and surface area of the plates incorporated into the basket, the greater will be the heat transfer capacity of the heat exchanger. The principal object of the present invention is to maximize these factors of mass and surface area yet retaining the cage effect that can be achieved by the use of bars across the ends of the baskets as discussed in the preceding paragraph. Another advantage achieved by the present invention is that in embodiments of the present invention the bars not only restrain the heat exchanger plates against endwise shifting, but also provide a restraint against transverse shifting movement.

In the present invention, the ends of the plates are provided with recesses, through which recesses the bars at the ends of the basket extend. The recesses are of a size only sufficient to receive the bars. The ends of the plates are brought out to approximately the ends of the baskets, that is, approximately coplanar with the outer surfaces of the bars. This enables the basket to incorporate a maximum mass and surface area of heat exchanger elements while still incorporating bars to prevent the endwise shifting of the plates beyond the ends of the basket. Furthermore, with such a construction, the bars not only act to prevent an endwise shifting of the plates, but also serve as a restraint to a transverse movement of the plates since the plates will abut one or both sides of a bar depending upon the position of the bar in the basket.

I am aware that U.S. Pat. No. 2,579,212 incorporates some structural elements which extend through the plates, normal thereto. However, these structural elements (40 in FIG. 3 of the patent) are spokes of the rotor with no indication that they are to have any restraining effect on the plate. An examination of the patent would not suggest that any such restraining effect might be present because the drawing shows these spokes extending through relatively large openings in the plates so that the plates do not abut the spokes. The plates could shift substantially in the rotor before contacting the spokes.

Also, an effort was made some years ago to fasten the stack of plates, which were used as the operative component of a basket, together with long pins. This was done in an effort to overcome the problem, encountered with the large baskets, that the outer plates would bulge outwardly due to the size of the stack. Holes, normal to the plates, were drilled through the stack and pins or rods were run through the holes and welded to the outer plates in an effort to hold the stack compressed and not bulged. This procedure was abandoned, probably because of the problem of forming the holes intermediate the edges of the sheets. If the sheets were drilled one at a time the holes invariably would not be in alignment. When an effort was made to drill the holes through the complete stack, the drill would contact at least some of the sheets at locations at which the sheets had sloping conformations (employed to define passageways between the sheets). The contact of the drill on the sloping face would cam the drill to one side resulting in an off-centered opening and/or a broken drill. In any event, the practice was dropped and was nothing more than an abandoned experiment.

DESCRIPTION OF THE DRAWINGS

FIG. 1 is a perspective view of a basket incorporating the invention;

FIG. 2 is an enlarged isometric view of a part of the stack of plates used in the embodiment of FIG. 1; and FIG. 3 is a view corresponding to FIG. 2 but showing portions of the bars fitting into the stack of plates.

DESCRIPTION OF SPECIFIC EMBODIMENT

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

The basket of FIG. 1 is of a type that might be used in a regenerative heat exchanger such as is illustrated in FIGS. 1 and 2 of U.S. Pat. 3,314,472. This type of heat exchanger has a rotor with a plurality of pockets, each pocket accepting a basket.

The basket of FIG. 1 comprises a frame, generally 10, within which is a stack of plates, generally 11. While each of the plates of the stack abuts adjacent plates, the plates have conformations such that portions thereof will be spaced apart so as to define fluid passageways, e.g., 13, therebetween. These fluid passageways extend from one end of the stack to the other so that the fluid to or from which heat is to be transferred can flow through the stack in one of the directions indicated by the double arrow 14. The exact conformation of the plates to provide such spacing (or passageways) is unimportant to the present invention. In the illustrated embodiment there are two types of plates 15 and 16, respectively, which are used alternately to make up the stack. Each type of plate has a specific conformation, which conformation differs from that of the other plate, and the combination thereof is such to space parts of the plates apart to define the passageways.

The frame of the basket includes outer frame plates 19 and 20, respectively. The sides of these frame plates are bent over to form flanges **19*a* and 20*a*, respectively. At each end are three bars consisting of a center bar 21 and two outer bars 22. Each of these bars is welded to the respective outer plates 19 and 20. While FIG. 1 shows the outer bars slightly spaced from the plate flanges, it is likely that most manufacturers would want to position the bars in abutment with the flanges. The number and placement of the bars also will depend upon the preferences of a particular manufacturer or user, as well as upon the size and shape of the baskets for a particular heat exchanger. The bars have outer faces 21*a*, 22*a*, inner faces 21*b*, 22*b*, and side faces 21*c*, 22*c***, respectively. Again, the sizes of the respective faces will vary from baskets of one type of manufacturer to another but will be of a predetermined size for a particular basket.

The plates 15 and 16 have end edges 25. At these ends the plates are formed with recesses to receive the bars. Thus in plate 15 of FIG. 2 there is a recess 26 to receive center bar 21 and a recess 27 to receive an outer bar 22. At recess 26 plate 15 has two faces 28 substantially normal to the ends of the plate and a face 29 substantially parallel to the ends of the plate. The length of faces 28 generally corresponds to the width of face **21*c* of the bar while the length of face 29 generally corresponds to the width of face 21*b* of the bar. Thus the bar will fit snugly within the recess, with only sufficient clearance normally being provided to permit an easy fabrication of the basket. Similarly, at recess 27 there are faces 30 and 31 whose lengths generally correspond to the widths of faces 22*c* and 22*b*, respectively. With this construction the ends 25 of the plates and the outer faces 21*a*, 22*a* of the bars are substantially coplanar. While the end edges 25 could be set inwardly from the outer faces 21*a*, 22*a*, such a construction would reduce the plate surface area incorporated into a basket. The remaining plates have recesses corresponding to those just described with respect to plate 15**. The materials employed for the various elements of a basket will correspond to those used for conventional baskets.

Since the edges 29 and 31 of the plates abut the faces **21*b* and 22*b*, respectively, of the plates, the plates are effectively restrained against endwise shifting (i.e., in the directions indicated by double arrow 14). Similarly, the side faces 28 and 30 (as well as the face corresponding to 30** at the opposite side of the basket) being in abutment with the side faces of the bars serve to restrain the plates against transverse movement.

I claim:

1. In a basket for use in a regenerative heat exchanger of the type wherein a fluid to or from which heat is to be transferred is passed through the basket from one end thereof to another end thereof and wherein there is a space of a predetermined size in the heat exchanger which is available to receive the basket, said basket comprising an outer frame open at said ends, a stack of a plurality of heat exchange plates within said frame, each of said plates having end edges generally corresponding to said ends of the basket, said plates abutting adjacent plates of the stack and defining fluid passages therebetween which passages extending from end to end of the plates, said frame including a plurality of bars across said ends of the basket to prevent said plates from shifting endwise in the basket, each of said bars having a first face of a given width in juxtaposition to the plate edges and a second face of a given width which is generally normal to said end edges, the improvement comprising:

each of said plates having a recess at each location where the plate abuts a bar, each recess having a width as measured parallel to the edge of the plate which substantially corresponds to said given width of said first face, and having a length as measured normal to said end edge of the plate which substantially corresponds to said given width of said second face, said bars being positioned in said recesses, whereby said plates extend substantially to said ends of the basket and thus, for a basket of a given size, there is nearly a maximum amount of plate surface available for heat exchange purposes.

* * * * *